US007221155B2

(12) United States Patent
Newman

(10) Patent No.: US 7,221,155 B2
(45) Date of Patent: May 22, 2007

(54) INVENTORY COUNTER FOR OIL AND GAS WELLS

(75) Inventor: Frederic M. Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 153 days.

(21) Appl. No.: 10/760,650

(22) Filed: Jan. 20, 2004

(65) Prior Publication Data

US 2004/0196032 A1 Oct. 7, 2004

Related U.S. Application Data

(60) Provisional application No. 60/441,212, filed on Jan. 21, 2003.

(51) Int. Cl.
*G01N 27/72* (2006.01)

(52) U.S. Cl. ..... 324/228

(58) Field of Classification Search ..... 324/228
See application file for complete search history.

(56) References Cited

U.S. PATENT DOCUMENTS

| | | | | |
|---|---|---|---|---|
| 3,843,923 | A | 10/1974 | De Vries et al. | 324/34 R |
| 5,671,155 | A * | 9/1997 | Edens et al. | 702/38 |
| 5,720,345 | A * | 2/1998 | Price et al. | 166/254.2 |
| 6,079,490 | A | 6/2000 | Newman | 166/77.51 |
| 6,164,493 | A | 12/2000 | Shelton, Jr. | 222/1 |
| 6,168,054 | B1 | 1/2001 | Shelton, Jr. | 222/608 |
| 6,209,639 | B1 | 4/2001 | Newman | 166/250.01 |
| 6,212,763 | B1 | 4/2001 | Newman | 29/702 |
| 6,213,207 | B1 | 4/2001 | Newman | 166/250.01 |
| 6,241,020 | B1 | 6/2001 | Newman | 166/250.01 |
| 6,253,849 | B1 | 7/2001 | Newman | 166/255.1 |
| 6,276,449 | B1 | 8/2001 | Newman | 166/53 |
| 6,374,706 | B1 | 4/2002 | Newman | 81/57.34 |
| 6,377,189 | B1 | 4/2002 | Newman | 340/854.6 |
| 6,580,268 | B2 | 6/2003 | Wolodko | 324/240 |
| 6,720,764 | B2 * | 4/2004 | Relton et al. | 324/235 |
| 6,802,373 | B2 * | 10/2004 | Dillenbeck et al. | 166/255.1 |
| 2002/0156582 | A1 | 10/2002 | Newman | 702/5 |
| 2002/0156591 | A1 | 10/2002 | Newman | 702/45 |
| 2002/0156670 | A1 | 10/2002 | Newman | 705/9 |
| 2002/0156730 | A1 | 10/2002 | Newman | 705/40 |
| 2003/0042020 | A1 | 3/2003 | Newman | 166/250.15 |

FOREIGN PATENT DOCUMENTS

| | | |
|---|---|---|
| EP | 1130213 A1 | 9/2001 |
| GB | 1602065 | 11/1981 |

OTHER PUBLICATIONS

International Search Report, mailed Jul. 5, 2004. PCT Application Serial No. PCT/US2004/001577, filed Jan. 20, 2004.

* cited by examiner

*Primary Examiner*—Reena Aurora
(74) *Attorney, Agent, or Firm*—King & Spalding LLP

(57) ABSTRACT

A magnetic induction device mounted at the wellhead that is capable of measuring changes in magnetic flux can recognize when a tubing joint or casing collar passes in or out of the well. The number of changes in magnetic flux directly correlates to the number of joints and collars that have passed, and therefore an accurate inventory of the number of lengths of casing or tubing that are run into the well can be automatically maintained.

21 Claims, 5 Drawing Sheets

How the system operates

INVENTORY COUNTER FOR OIL AND GAS WELLS

BACKGROUND OF THE INVENTION

After a drilling rig is used to drill an oil or gas well and install the well casing, the rig is dismantled and removed from the site. From that point on, a well service rig typically is used to service the well. Servicing includes, among many other things, installing and removing inner tubing strings and sucker rods. When a drilling or well service rig is working on a well, it is incumbent upon the crew operating the rig to create a record of the casing, tubing, or rods installed into and removed from the well. This record is an important part of the well file, or well history, and will often be referred to at later dates during the life of the well. However, counting individual casing, tubing, or sucker rod segments, or their joints or connections, and then later correlating this count to the depths within the well of the individual casing, tubing, or rod segments, or their joints or connections, can be a laborious task that is very much susceptible to human error.

While there are many devices and methods of locating and recording tubing connections, this technology generally is applied to casing and tubing that has already been run into the well. For examples, see U.S. Pat. Nos. 6,032,739 and 6,003,597. Current well servicing technology does not include a means for automatically counting the number of joints or connections at the same time the casing, tubing, or rods are being pulled from or run into a well. Furthermore, there is no technology that can automatically reduce this count into database form. Finally, there is no system that can automatically give the rig operator a continuously updated rod, tubing, or casing count as these items are being run in or pulled from a well. This invention alleviates these deficiencies.

SUMMARY OF THE INVENTION

Rods, tubing, and casing that are run into and out of a well are generally made of some kind of metal, usually iron or some alloy of a ferrous material. The magnetic flux density and magnetic permeability of the individual tubes is approximately uniform due to the consistent metal characteristics, uniform wall thickness, and uniform outer and inner diameters that are generally held to strict manufacturing specifications. Only when the ends of the tubing and casing are screwed together, using a coupling or collar, does the magnetic flux density measurably change within the length of the pipe string. A magnetic induction device mounted at the wellhead that is capable of measuring changes in magnetic flux can monitor these changes in flux at each joint or collar, and thereby recognize when a tubing joint or casing collar passes in or out of the well. The number of changes in magnetic flux directly correlates to the number of joints and collars that have passed; therefore, an accurate inventory of the number of lengths of casing or tubing that are run into the well can be automatically maintained.

DESCRIPTION OF ILLUSTRATIVE EMBODIMENTS

Figure 1:
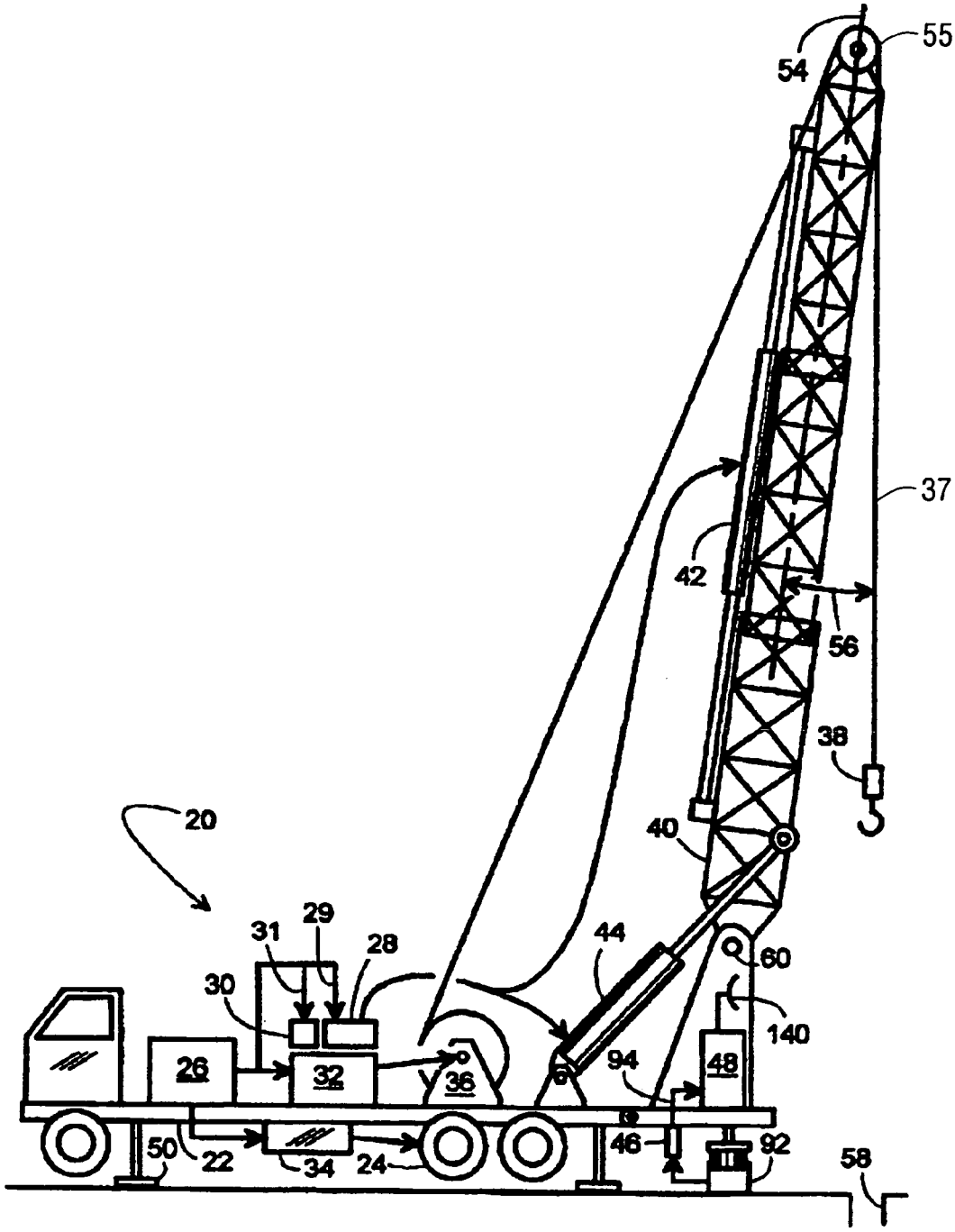
FIG. 1 is a side view of a prior art workover rig with its derrick extended.
Figure 2:
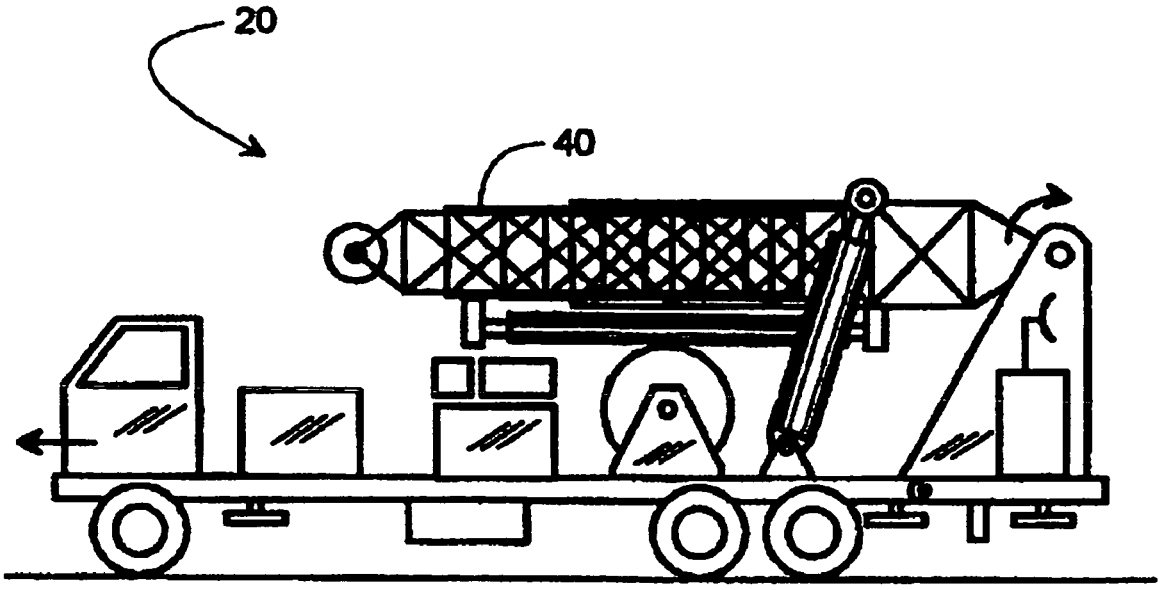
FIG. 2 is a side view of a prior art workover rig with its derrick retracted.
Figure 3:
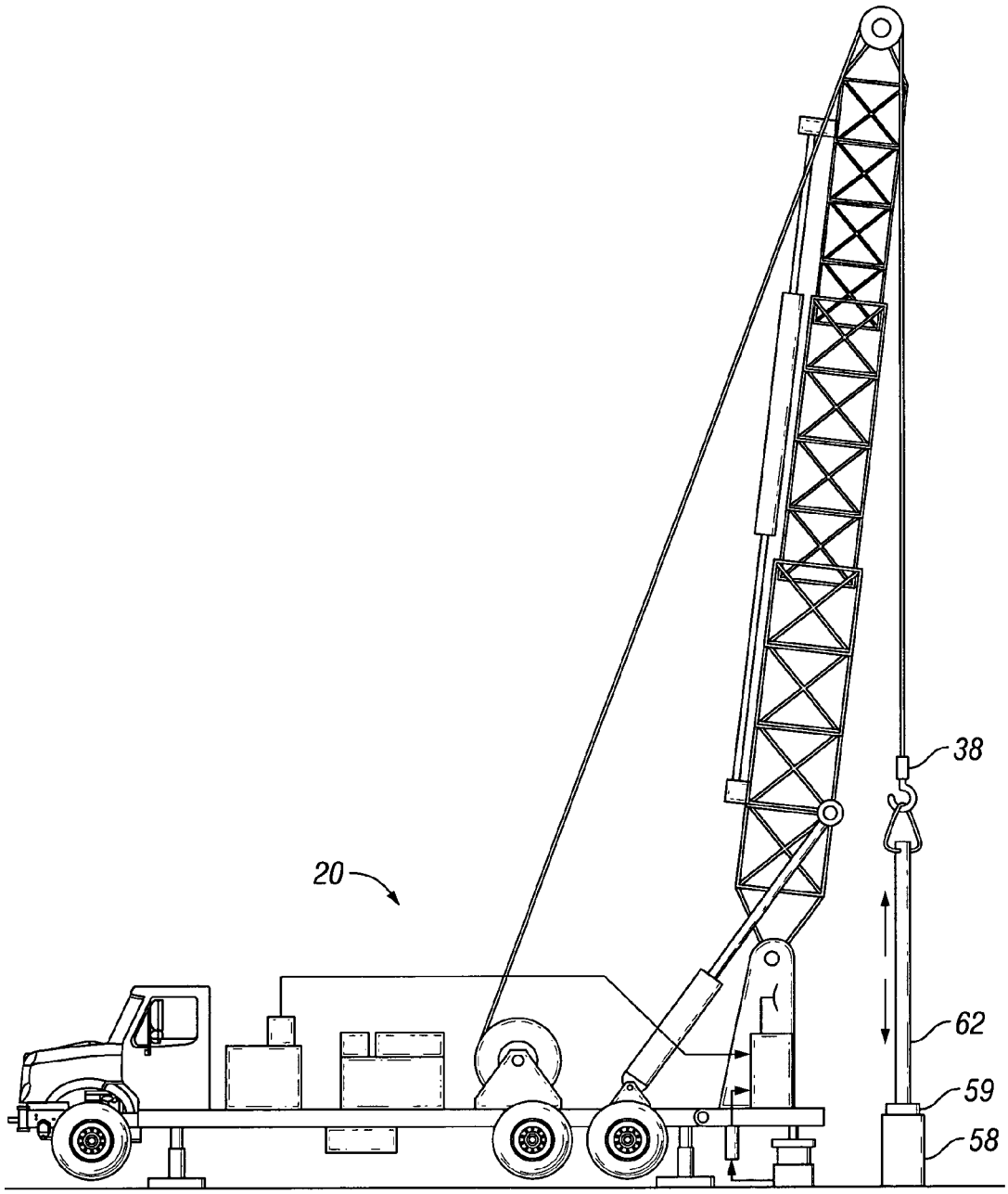
FIG. 3 illustrates the prior art raising and lowering of an inner tubing string.

Referring to FIG. 1, a retractable, self-contained workover rig 20 is shown to include a truck frame 22 supported on wheels 24, an engine 26, an hydraulic pump 28, an air compressor 30, a first transmission 32, a second transmission 34, a variable speed hoist 36, a block 38, an extendible derrick 40, a first hydraulic cylinder 42, a second hydraulic cylinder 44, a monitor 48, and retractable feet 50. Engine 26 selectively couples to wheels 24 and hoist 36 by way of transmissions 34 and 32, respectively. Engine 26 also drives hydraulic pump 28 via line 29 and air compressor 30 via line 31. Air compressor 30 powers a pneumatic slip (not shown), and hydraulic pump 28 powers a set of hydraulic tongs (not shown). Hydraulic pump 28 also powers hydraulic cylinders 42 and 44 that respectively extend and pivot derrick 40 to selectively place derrick 40 in a working position (FIG. 1) and in a retracted position (FIG. 2). In the working position, derrick 40 is pointed upward, but its longitudinal centerline 54 is angularly offset from vertical as indicated by angle 56. This angular offset 56 provides block 38 access to a well bore 58 without interference from the derrick framework and allows for rapid installation and removal of inner pipe segments, such as inner pipe strings 62 and/or sucker rods (FIG. 3).

Many wellbores consist of a pipe within a pipe. The outer pipe string or casing typically consists of pipe sections coupled together by way of casing collars. The inner pipe string or rods or tubing typically consists of pipe sections interconnected by way of pipe couplings. When installing inner pipe string segments, the individual pipe segments are screwed together using hydraulic tongs (not shown). Hydraulic tongs are known in the art, and refer to any hydraulic tool that can screw together two pipes or sucker rods. During make-up operations, block 38 supports each pipe segment while it is being screwed into the downhole pipe string. After the connection is made up, block 38 supports the entire string of pipe segments so that the entire string, which includes the new pipe segment, can be lowered into the well. After lowering, the entire string is secured, and the block 38 retrieves another new pipe segment for connection with the entire string. Conversely, during breakout operations, block 38 raises the entire string of pipe segments out of the ground until at least one individual segment is exposed above ground. The string is secured, and then block 38 supports the pipe segment while it is uncoupled from the string. Block 38 then moves the individual pipe segment out of the way, and returns to raise the string so that further individual pipe segments can be detached from the string.

Hoist 36 controls the movement of a cable 37 that extends from hoist 36 over the top of a crown wheel assembly 55 located at the top of derrick 40, supporting traveling block 38. Hoist 36 winds and unwinds cable 37, thereby moving the traveling block 38 between its crown wheel assembly 55 and its floor position, which is generally at the wellbore 58, but can be at the height of an elevated platform (not shown) located above wellbore 58.

Rods, tubing, and casing that are run into and out of a well are generally made of some kind of metal, usually iron or some alloy of a ferrous material. The magnetic flux density and magnetic permeability of the individual tubes is approximately uniform due to the consistent metal characteristics, uniform wall thickness, and uniform outer and inner diameters that are generally held to strict manufacturing specifications. Only when the ends of the tubing and casing are screwed together, using a coupling or collar, does the magnetic flux density measurably change within the length of the pipe string. This change is usually measurable by a magnetic induction device mounted at the wellhead that is capable of measuring magnetic flux.

Devices for measuring magnetic flux are well known in the art, and many variations of magnetic flux measuring devices are in use in the industry today. Some such devices are disclosed in U.S. Pat. Nos. 6,032,739 and 6,003,597, both of which are incorporated herein by reference. One such common device simply comprises a coil of wire placed around or near a magnet. Some commercial devices employ two permanent magnets with like poles pointed toward the coil. Hall effect transducers and magneto sensors are also known in the art and can be used with this invention.

In some embodiments of the present invention, a voltmeter measures the changes in magnetic flux by measuring an induced current that is created in a coil of wire as a result of the change in magnetic flux. In some cases, the voltmeter is calibrated to read zero volts at a point in which the casing or tubing wall is exposed to the magnetic field. Therefore an increase or decrease in voltage will indicate the passing of the coupling or joint as it passes through the magnetic field. When the voltmeter reads a certain voltage, the counting system recognizes that as a coupling or joint, thereby only counting voltmeter readings at or above a certain level. It is well within the skill of one of ordinary skill in this art to determine the minimum appropriate voltmeter reading that corresponds to the passing of a coupling or a joint, as it will likely be different with every application.

Figure 4:
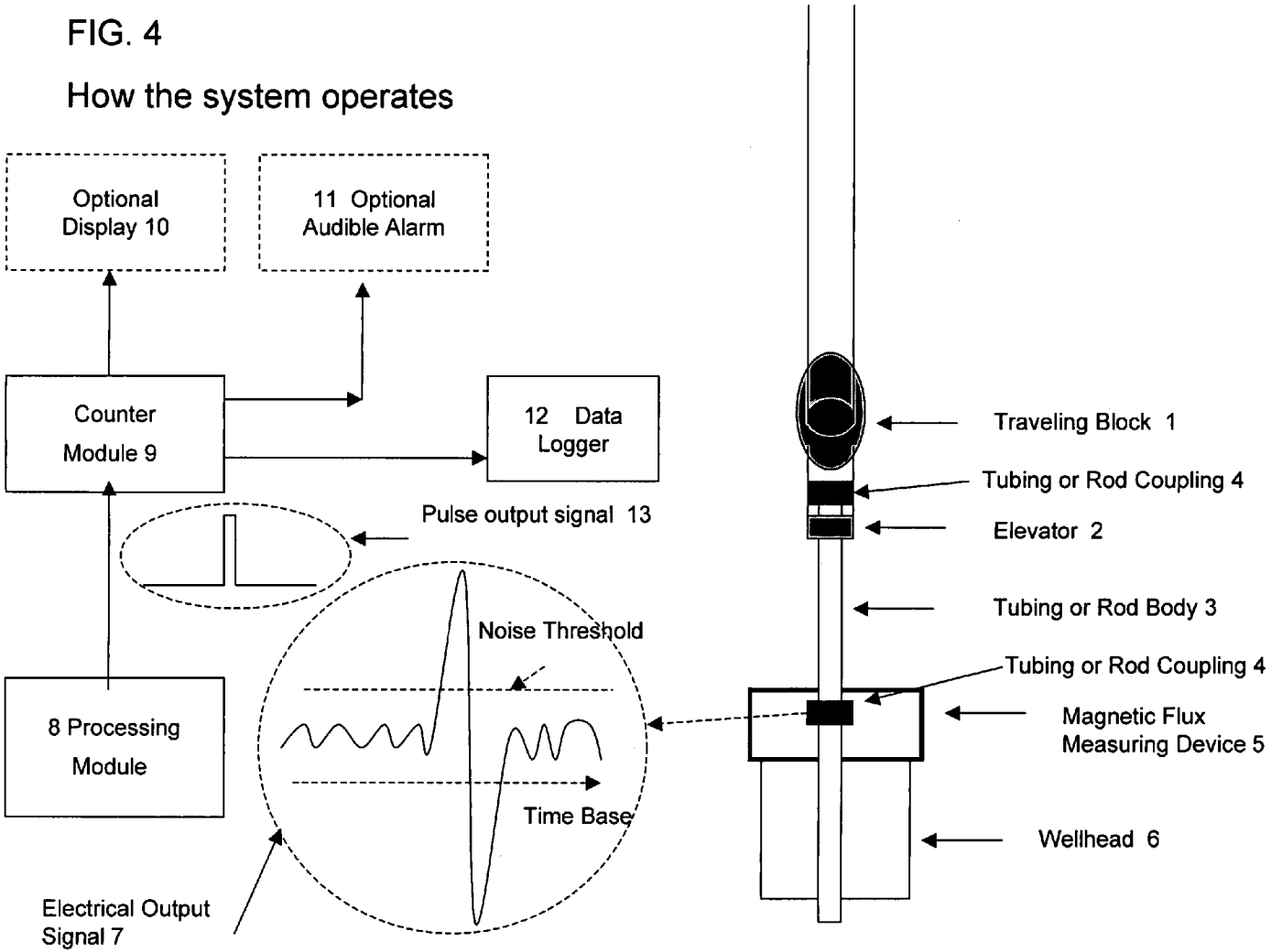
FIG. 4 shows a general overview of one embodiment of the present invention.

FIG. 4 shows an overview of one embodiment of the present invention. As traveling block 1 pulls or runs tubing or rods 3 out of or into the hole, tubing or rod coupling 4 passes by, near to, or through the wellhead 6 magnetic flux measuring device 5. The tubing body generally is uniform, so the signal, if any, generated by the magnetic flux measuring device 5 as the tubing body passes also is uniform; a change in magnetic flux lines is necessary to induce a change in current. In contrast, when a coupling passes near or through magnetic flux measuring device 5, the nature of the coupling, either due to the air gap theory or the increase in ferrous cross-sectional area, causes an interruption and movement in the magnetic flux lines. This shift, change, or interruption induces an output voltage into a pick-up coil. The corresponding output signal as shown in graph 7 is indicative of either a measured voltage or current. This signal is normally very noisy, as the signal-to-noise ratio is low, so signal 7 is, in some embodiments, fed into a processing module 8. Processing module 8 filters the signal and has an adjustable threshold level so that the output of module 8 is a clean direct current (DC) pulse output signal 13 representative of any input to processing module 8 above the set threshold level. Therefore, properly setting the threshold level results in processing module 8 generating a pulse each time a coupling passes near or through magnetic flux measuring device 5. The pulse signal 13 that is the output of processing module 8 is then fed to a counter module 9, which simply counts input pulses (13). This information can then be logged by a data logger 12 into a database as a time or event, or simply tallied at the end of a run to give a total count of the joints or couplings that were run through measuring device 5. In the alternative, the output from counter module 9 can be fed to a display screen 10. In a further embodiment, an audible alarm 11 can be activated each time a coupling passes through the wellhead.

Figure 5:
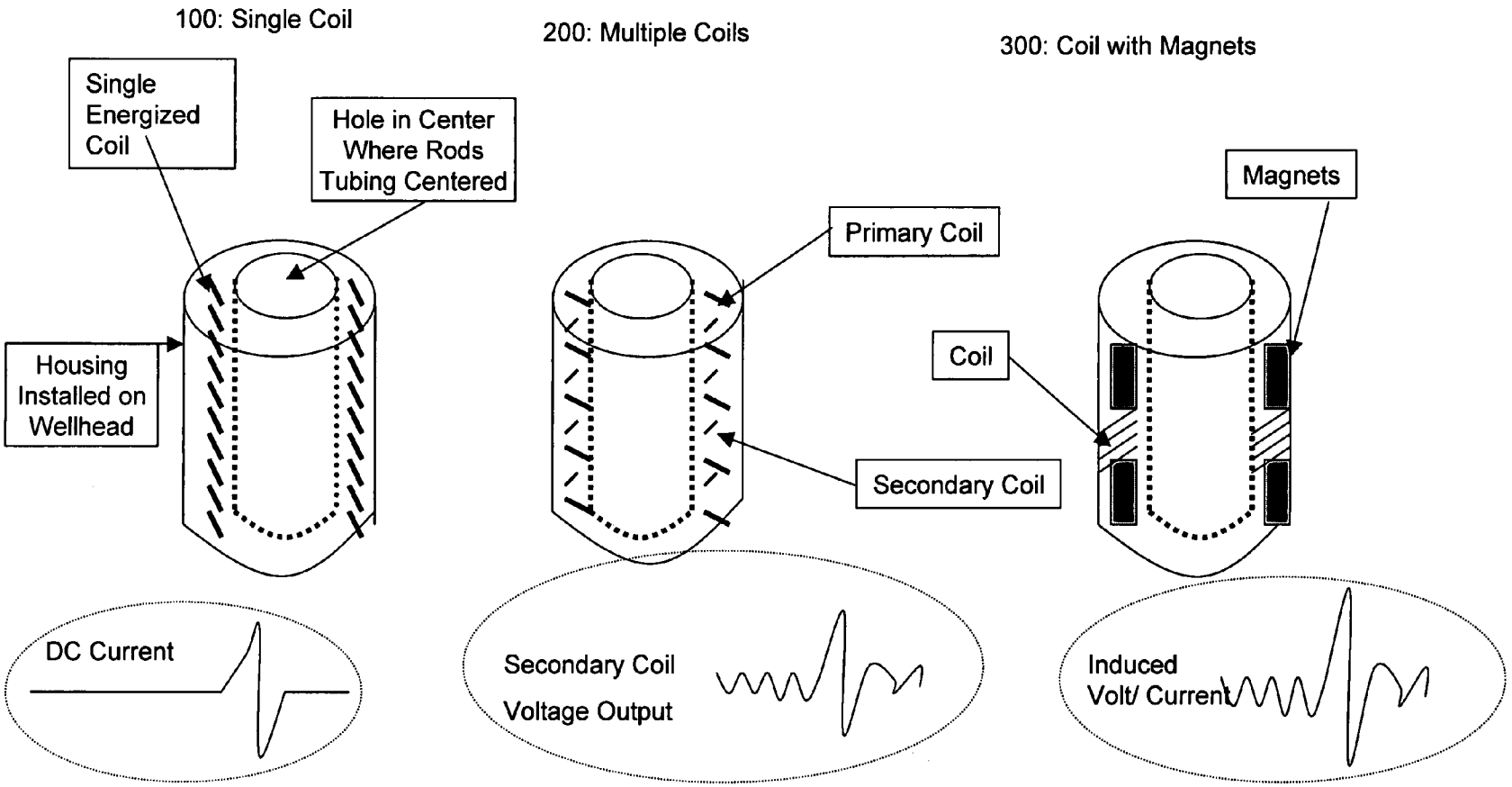
FIG. 5 shows several embodiments of one element of the present invention.

Referring to FIG. 5, several means to detect magnetic flux change are shown. The first element 100 shows a single coil energized with a DC current. When the metal coupling or joint passes into or out of the wellhead, it causes the DC current to change. Monitoring this change in the DC current indicates when a coupling passes into or out of the wellhead. The second element 200 shows the use of two coils, a primary coil that creates a magnetic field, and a second coil that senses the induction caused by the passing of a coupling. Using this embodiment would entail monitoring the voltage output of the second coil in order to count the number of couplings that pass through the wellhead. Finally, the third element 300 shows magnets with a coil that can be located between the magnets or wrapped around. As the coupling passes by, the flux lines change, thereby inducing a voltage into the coil.

The change in magnetic flux is thought to be caused by air gaps in the threads between the coupling and/or collar or by the increased volume of metal that is uniquely present at a joint or coupling. Regardless of what causes the change in magnetic flux, when the magnetic flux measuring device detects a significant variation, it can be concluded that a collar or joint is passing by the measuring device. By counting each pulse—i.e., each significant variation in flux—an operator or other person can determine how many joints are being run into the hole or pulled out of the hole. Because there is likely to be noise in the magnetic flux signal, in some embodiments the signal is filtered so that only the significant variations in flux—when a coupling or joint passes—are measured and counted.

Once the magnetic flux measuring device detects a significant variation in the magnetic flux, that signal is converted into a countable signal, which is then fed into a suitable counter such as a relay-driven stepping mechanical counter or a GUI. The counting device then monitors and keeps track of the number of pulses, and therefore the number of joints, that have passed the sensor. Devices for converting the flux variations into a countable signal and then feeding the signal into a counter are well known in the art, and may include a signal processor, as described above. In some embodiments, the signal may be fed directly into a computer system and automatically placed into an electronic spreadsheet. In this way, the number of lengths of tubing that are run into and out of the hole can be easily tracked by the system operator.

In one embodiment, instead of mounting a sensor on or near the wellhead, a coil of wire or Hall effect sensor is embedded or molded into a wiper rubber. As shown in FIG. 3, a wiper rubber 59 is placed around the tubing or rod 62 being run into the well so as to wipe off any excess fluids from the tubing or rod. The signal detection is thus independent of the wellhead while providing the same results as the embodiments disclosed above.

Although the invention is described with respect to a preferred embodiment, modifications thereto will be apparent to those skilled in the art. Therefore, the scope of the invention is to be determined by reference to the claims which follow.

What is claimed is:

1. A method of counting a plurality of pipe segments at a well, comprising producing a magnetic field near the well with a magnetic field detection device embedded into a wiper rubber positioned around an exterior of the pipe segments adjacent to a wellhead, moving the plurality of pipe segments into or out of the well, detecting the changes in the magnetic field, caused by the passing of the pipe segment connectors through the magnetic field and counting the number of changes in the magnetic field to thereby produce a pipe segment count.

2. The method of claim 1, wherein the plurality of pipe segments are selected from the group consisting of joints of casing, tubing and rods.

3. The method of claim 1, wherein the pipe segment connectors are selected from the group consisting of couplings and collars.

4. The method of claim 1, wherein the magnetic field detection device is selected from the group consisting of a magnetic induction device, a single magnet, two permanent magnets with like poles pointed in the same direction, Hall effect transducers, magneto sensors, and an energized coil of wire.

5. The method of claim 1, wherein the changes in the magnetic flux are detected by voltmeter attached to a coil of wire placed near the magnetic field detection device.

6. The method of claim 1, wherein the changes in magnetic field are counted using a device selected from the group consisting of a relay-driven stepping mechanical counter and a GUI.

7. The process of claim 1, wherein the pipe segment count is fed into a computer system.

8. The process of claim 7, wherein the pipe segment count is automatically fed onto an automatic spreadsheet.

9. The process of claim 1, wherein the magnetic field detection device is selected from a group consisting of a coil of wire or a hall sensor.

10. The method of claim 1, further comprising a processing module to filter the signal from the magnetic flux measuring device.

11. The method of claim 10, wherein the process module produces a pulse signal based on the filtered magnetic flux measuring device signal, wherein the pulse is indicative of the number of pipe segments passing onto or out of the well.

12. The method of claim 11, wherein a counter counts the number of pulses.

13. The method of claim 1, wherein an alarm sounds each time a pipe segment passing into or out of the well.

14. The method of claim 1, wherein the number of pipe segments passing onto or out of the well is shown on a display.

15. The method of counting a plurality of pipe segments at a well, comprising producing a magnetic field near the well with a magnetic field measuring device, wherein the magnetic field measuring device is embedded into or molded into a wiper rubber positioned around the exterior of the pipe segments adjacent to a wellhead, moving the plurality of pipe segments into or out of the well, detecting the changes in the magnetic filed caused by the passing of the pipe segment connectors through the magnetic field, employing a processing module to filter noise in the signal from the magnetic field measuring device, counting the number of changes in the magnetic field to thereby produce a pipe segment count; and feeding the pipe segment count into a computer system.

16. A method of claim 15, wherein the changes in the magnetic flux are detected by voltmeter attached to a coil of wire placed near the magnetic field detection device.

17. The process of claim 15, wherein the pipe segment count is automatically fed onto an automatic spreadsheet.

18. The method claim 15, wherein the process module produces a pulse signal based on the filtered magnetic field measuring device signal, wherein the pulse is indicative of the number of pipe segments passing onto or out of the well.

19. The method of claim 18, wherein a counter counts the number of pulses.

20. The method of claim 15, wherein an alarm sounds each time a pipe segment passing into or out of the well.

21. The method of claim 15, wherein the number of pipe segments passing onto or out of the well is shown on a display.

* * * * *

UNITED STATES PATENT AND TRADEMARK OFFICE

CERTIFICATE OF CORRECTION

PATENT NO. : 7,221,155 B2
APPLICATION NO. : 10/760650
DATED : May 22, 2007
INVENTOR(S) : Frederic M. Newman It is certified that error appears in the above-identified patent and that said Letters Patent is hereby corrected as shown below:

The word "hall" in Claim 9 should be corrected to read as --Hall--

Signed and Sealed this

Seventh Day of August, 2007

JON W. DUDAS
*Director of the United States Patent and Trademark Office*